US009469496B2

(12) United States Patent
Tokuda

(10) Patent No.: US 9,469,496 B2
(45) **Date of Patent: *Oct. 18, 2016**

(54) TRACTOR UNIT, CONVEYANCE DEVICE, AND PRINTER

(71) Applicant: SEIKO EPSON CORPORATION, Tokyo (JP)

(72) Inventor: Takeshi Tokuda, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/706,977

(22) Filed: May 8, 2015

(65) Prior Publication Data

US 2015/0239697 A1 Aug. 27, 2015

Related U.S. Application Data

(63) Continuation of application No. 13/939,473, filed on Jul. 11, 2013, now Pat. No. 9,056,494.

(30) Foreign Application Priority Data

Aug. 6, 2012 (JP) ..... 2012-173752

(51) Int. Cl.

| | |
|---|---|
| ***B65H 20/20*** | (2006.01) |
| ***B41J 13/00*** | (2006.01) |
| ***B41J 11/30*** | (2006.01) |

(52) U.S. Cl.

CPC ..... *B65H 20/20* (2013.01); *B41J 11/30* (2013.01); *B41J 13/0009* (2013.01); *B65H 2403/481* (2013.01); *B65H 2403/732* (2013.01)

(58) Field of Classification Search

CPC ..... B41J 11/007; B41J 2/2114; B41J 11/42; B41J 11/48

See application file for complete search history.

(56) References Cited

U.S. PATENT DOCUMENTS

| | | | | |
|---|---|---|---|---|
| 7,673,864 | B2 | 3/2010 | Mizuno et al. | |
| 9,056,494 | B2 * | 6/2015 | Tokuda | B41J 13/0009 |
| 2008/0070772 | A1 * | 3/2008 | Mizuno | B65H 23/042 493/442 |
| 2012/0050439 | A1 | 3/2012 | Kawasaki et al. | |

FOREIGN PATENT DOCUMENTS

| | | | | |
|---|---|---|---|---|
| JP | 3-208683 | A | 9/1991 | |
| JP | 4-180000 | A | 6/1992 | |
| JP | 5-338286 | A | 12/1993 | |
| JP | 5-338881 | A | 12/1993 | |
| JP | 06-263296 | * | 9/1994 | B41J 11/32 |
| JP | 6-263296 | A | 9/1994 | |
| JP | 9-188445 | A | 7/1997 | |
| JP | 2002-296855 | A | 10/2002 | |
| JP | 2003-285482 | A | 10/2003 | |
| JP | 2006-8265 | A | 1/2006 | |

* cited by examiner

*Primary Examiner* — Henok Legesse
(74) *Attorney, Agent, or Firm* — Hauptman Ham, LLP

(57) ABSTRACT

A tractor unit has first and second tractors with tractor pins that engage sprocket holes on opposites sides of continuous paper. A tractor support shaft supports the tractors movably in the device width direction. A frame supports the tractor support shaft movably in the device width direction. A clamping mechanism is provided for fixing the second tractor on the tractor support shaft. The first tractor 31 is disposed at a reference position in the device width direction. A biasing member biases the tractor support shaft in a second direction when the tractor support shaft moves in a first direction opposite to the second direction.

5 Claims, 6 Drawing Sheets

TRACTOR UNIT, CONVEYANCE DEVICE, AND PRINTER

RELATED APPLICATION(S)

The instant invention is a continuation of U.S. patent application Ser. No. 13/939,473 filed Jul. 11, 2013 and claims priority to Japanese patent application No. 2012-173752 filed Aug. 6, 2012, the entire disclosure of which is incorporated by reference herein.

BACKGROUND

1. Technical Field

The present disclosure relates to a tractor unit for conveying fanfold paper or other continuous paper having sprocket holes, to a conveyance device including the tractor unit, and to a printer having the conveyance device.

2. Related Art

Japanese Unexamined Patent Appl. Pub. JP-A-2006-8265 describes a conveyance device for conveying continuous paper. The conveyance device disclosed in JP-A-2006-8265 has a paper feed roller, and a tractor unit disposed on the upstream side of the paper feed roller in the conveyance direction of the continuous paper. The tractor unit in JP-A-2006-8265 has a first tractor, a second tractor, a support shaft, and a clamping mechanism. The first tractor has first tractor pins that can engage first sprocket holes formed along one side in the width direction of the continuous paper. The second tractor has second tractor pins that can engage second sprocket holes formed along the other side in the width direction of the continuous paper. The support shaft supports the first tractor and second tractor so that both tractors can move in a transverse direction perpendicular to the conveyance direction of the continuous paper. The clamping mechanism holds the second tractor in a fixed position on the support shaft.

Continuous paper is set in the conveyance device described in JP-A-2006-8265 by engaging the first sprocket holes in the continuous paper with the tractor pins of the first tractor set to a reference position, then sliding the second tractor along the support shaft to a position appropriate to the width of the continuous paper and engaging the second sprocket holes of the continuous paper on the tractor pins of the second tractor, and then clamping the second tractor to the support shaft.

The conveyance device described in JP-A-2006-8265 conveys continuous paper that has already been printed on by an electrophotographic printer. When continuous paper is printed on using an electrophotographic process, the continuous paper may shrink widthwise due to the heat used to fuse the toner image formed on a photoconductive element to the continuous paper. Because the distance between the sprocket holes formed on one side of the continuous paper and the sprocket holes formed on the other side changes when the continuous paper shrinks widthwise, the sprocket holes of the continuous paper sometimes separate from the tractor pins of the first tractor or the tractor pins of the second tractor while the continuous paper is conveyed.

To prevent this, the tractor unit disclosed in JP-A-2006-8265 has a stop affixed to a position corresponding to the reference position on the support shaft, and disposes the first tractor to the reference position by pushing the first tractor towards the stop and away from the second tractor using a spring member so that the first tractor contacts the stop. When the width of the continuous paper shrinks, the first tractor moves toward the second tractor in resistance to the spring member and reduces the gap between the first tractor and the second tractor. The tractor unit can therefore prevent sprocket holes in the continuous paper from disengaging the tractor pins.

Separation of the sprocket holes from the tractor pins while the continuous paper is conveyed by a paper feed device using a tractor unit is not limited to when the width of the continuous paper shrinks as a result of the printing method. For example, when the conveyance direction of the continuous paper by the paper feed roller and the conveyance direction of the continuous paper by the tractor unit do not match precisely due to the dimensional precision of the paper feed roller and parts of the tractor unit, or the installation precision of the paper feed roller and tractor unit in the printer, the continuous paper may travel in a direction intersecting the conveyance direction due to the conveyance force of the paper feed roller, causing the sprocket holes to separate from the tractor pins. Using the tractor unit disclosed in JP-A-2006-8265 to avoid this is possible.

However, the inventor(s) has noted that when the continuous paper is set in the tractor unit disclosed in JP-A-2006-8265, the user may apply too much tension across the width of the continuous paper. More specifically, the continuous paper becomes easily skewed as it is pulled downstream by the conveyance force of the paper feed roller if there is slack across the width of the continuous paper between the first tractor and the second tractor when the continuous paper is set in the tractor unit. As a result, after engaging the tractor pins of the second tractor with the sprocket holes of the continuous paper, the user commonly pulls the second tractor in the direction away from the first tractor and applies tension across the width so that there is no slack in the continuous paper, and then clamps the second tractor to the support shaft.

If the user pulls the second tractor with such force that the first tractor moves toward the second tractor when pulling the second tractor away from the first tractor, tension will be applied to the continuous paper by both the excess tension applied by the user and the urging force of the spring member, and the second tractor will be clamped to the support shaft with excessive tension on the paper. However, the continuous paper conversely separates from the sprocket holes more easily if the continuous paper moves in a direction intersecting the conveyance direction when excessive tension is applied across the width of the continuous paper by the pair of tractors.

SUMMARY

In some embodiments, a tractor unit comprises first and second tractors, a support shaft, a frame, a biasing member and a clamping member. The first tractor has first tractor pins configured to be engaged in first sprocket holes formed in continuous paper to be conveyed in the paper conveyance direction along a first side of the continuous paper. The second tractor has second tractor pins configured to be engaged in second sprocket holes formed in the continuous paper along a second side of the continuous paper. The second side is opposite the first side across a paper width of the continuous paper. The support shaft extends in a transverse direction perpendicular to the conveyance direction of the continuous paper, and supports the first tractor and second tractor movably in the transverse direction. The frame supports the support shaft movably in the transverse direction. The biasing member is configured to bias the support shaft in the transverse direction. The clamping member is configured to fix the second tractor on the support shaft. The first tractor is disposed at a predetermined reference position in the transverse direction. The biasing member is configured to bias the support shaft in a second direction opposite a first direction, when the support shaft moves in the first direction oriented from the second tractor toward the first tractor.

In some embodiments, a conveyance device includes the tractor unit described above, a conveyance roller, and a drive source. The conveyance roller is disposed parallel to the support shaft and downstream of the tractor unit in the conveyance direction. The drive source is configured to rotationally drive the conveyance roller.

In some embodiments, a printing device includes the conveyance device described above, and a print unit that is disposed downstream in the conveyance direction from the conveyance device. The print unit is configured to print on the continuous paper conveyed by the conveyance device.

DESCRIPTION OF EMBODIMENTS

At least of one embodiment of the present invention is described below with reference to the accompanying figures. In the accompanying figures, arrow X indicates the conveyance direction of the continuous paper through the conveyance path, arrow X1 indicating forward (normal paper feed direction) and arrow X2 indicating reverse in the conveyance direction X. Arrow Y indicates the device width direction (transverse direction) Y perpendicular to the conveyance direction, arrow Y1 indicating a first direction Y1 from a second tractor to a first tractor of the tractor unit in the device width direction Y, and arrow Y2 indicating a second direction Y2 from the first tractor to the second tractor of the tractor unit in the device width direction Y.

General Configuration

Figure 1:
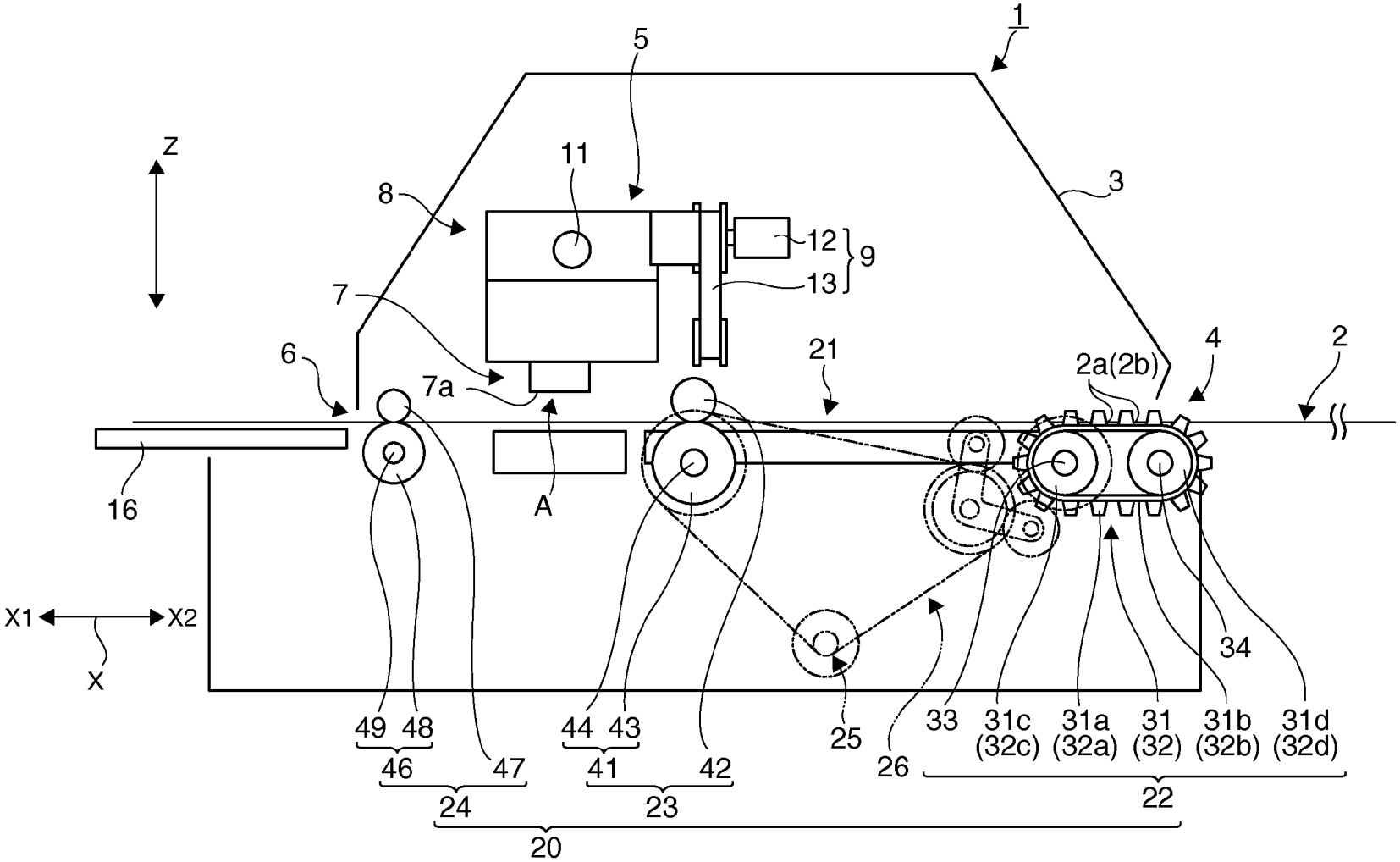
FIG. 1 is a side view of an inkjet printer according to at least of one embodiment of the invention.
Figure 2:
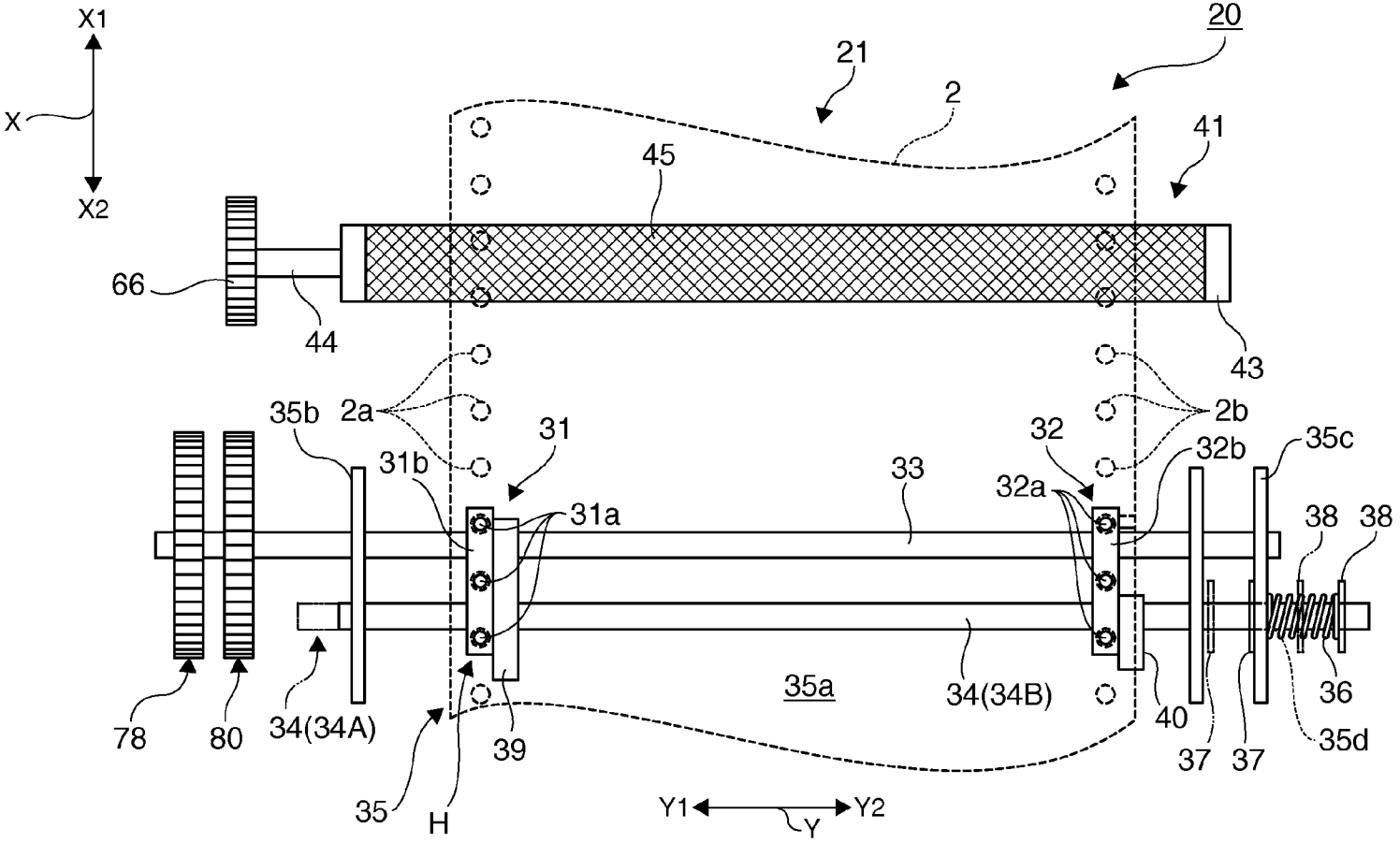
FIG. 2 is a plan view showing a conveyance device in the inkjet printer.

FIG. 1 is a side view that shows the overall configuration of an inkjet printer according to at least one embodiment of the invention. FIG. 2 is a plan view showing a conveyance device of the inkjet printer.

The inkjet printer (printing device) 1 pulls continuous paper 2 through the supply opening 4 disposed in the back of the printer case 3, prints on the continuous paper 2 with the print unit 5, and discharges the continuous paper 2 from a paper exit 6 disposed in the front of the printer case 3. The continuous paper 2 is, for example, fanfold paper, and has first sprocket holes 2*a* and second sprocket holes 2*b* formed at a uniform pitch along the length of the continuous paper 2 , and on both sides of the continuous paper 2 in the paper width direction as shown in FIG. 2.

The print unit 5 includes a printhead 7, carriage 8, and carriage moving mechanism 9. The printhead 7 has a plurality of nozzles 7*a* that eject ink droplets onto the continuous paper 2. The printhead 7 is carried on the carriage 8 with the nozzles 7*a* facing down on the z-axis shown in FIG. 1, that is, facing the continuous paper 2.

The carriage 8 is supported movably along a carriage shaft 11 that extends in the device width direction Y, and is moved bidirectionally in the device width direction Y by the carriage moving mechanism 9. The carriage moving mechanism 9 includes a carriage motor 12 and a timing belt 13 driven by the carriage motor 12. The carriage 8 is affixed to the timing belt 13, and is moved bidirectionally in the device width direction Y according to the operation of the carriage motor 12.

Figure 3:
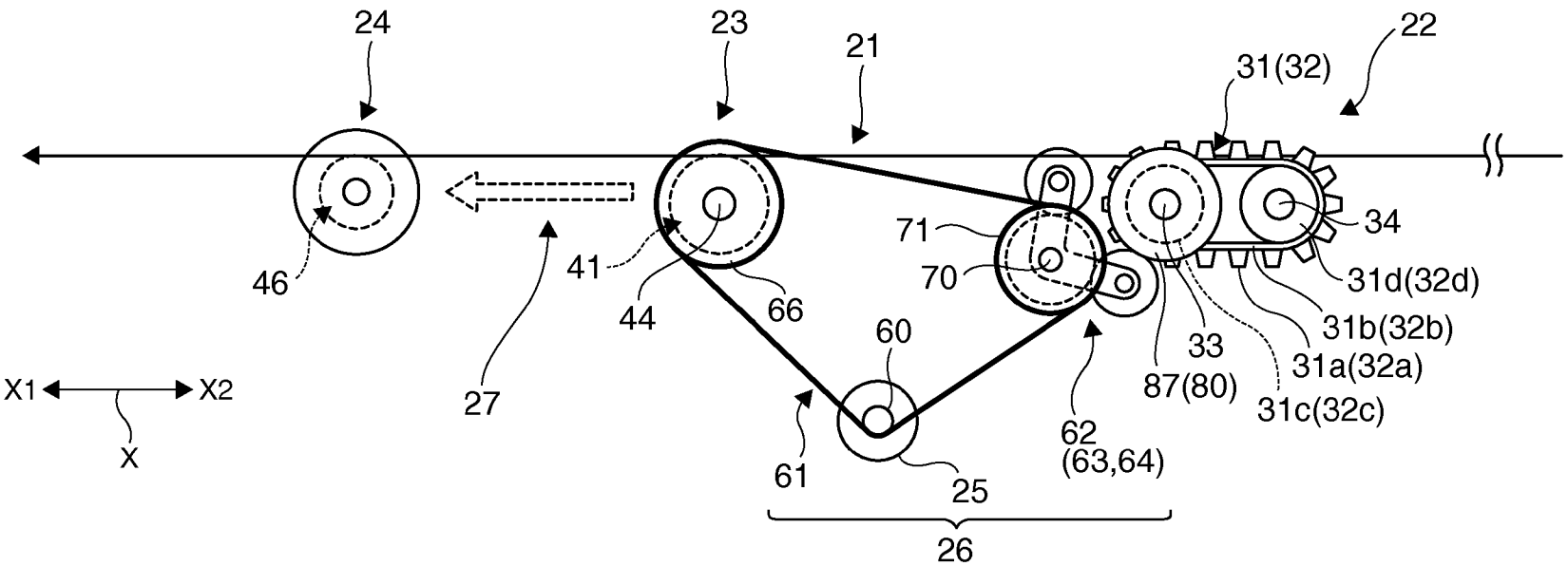
FIG. 3 is a side view showing a power transfer mechanism in the conveyance device.

The inkjet printer 1 also has a conveyance device 20 that conveys the continuous paper 2. FIG. 3 is a side view of the conveyance device 20.

As shown in FIG. 1, the conveyance device 20 includes a conveyance path 21, tractor unit 22, first conveyance mechanism 23, and second conveyance mechanism 24. As shown in FIG. 3, the conveyance device 20 also has a conveyance motor 25 that drives the tractor unit 22, first conveyance mechanism 23, and second conveyance mechanism 24; a drive power transfer mechanism 26 that transfers rotational drive power from the conveyance motor 25 to the tractor unit 22 and first conveyance mechanism 23; and a drive power transfer wheel train 27 that transfers the rotational drive power transferred to the first conveyance mechanism 23 from the conveyance motor 25 to the second conveyance mechanism 24.

The conveyance path 21 extends in the direction of arrow X in FIG. 1, starting from the supply opening 4, passing the printing position A of the printhead 7 of the print unit 5, and ending at the paper exit 6. The tractor unit 22, first conveyance mechanism 23, print unit 5, and second conveyance mechanism 24 are disposed in this order along the conveyance path 21 from the supply opening 4 side to the paper exit 6 side.

Tractor Unit

The tractor unit 22 is disposed near the supply opening 4. As shown in FIG. 2, the tractor unit 22 includes a first tractor 31 and a second tractor 32 that hold the continuous paper 2 on opposite sides of the paper width; a tractor drive shaft 33 (drive shaft) and a tractor support shaft 34 (support shaft) supporting the first tractor 31 and second tractor 32 movably in the device width direction Y; a frame 35 that supports the tractor drive shaft 33 and tractor support shaft 34; and a coil spring 36 (biasing or elastic member) that can bias or apply an urging force (pressure) urging (pushing) the tractor support shaft 34 in the device width direction Y of the continuous paper 2. The tractor drive shaft 33 and tractor support shaft 34 extend parallel to each other in the device width direction Y. The tractor drive shaft 33 is on the side of the tractor support shaft 34 closer to the first conveyance mechanism 23, or more specifically is downstream of the tractor support shaft 34 in the conveyance direction.

As shown in FIG. 1 and FIG. 2, the first tractor 31 includes a first tractor belt 31*b* (first endless belt) with multiple first tractor pins 31*a* disposed on the outside surface, and a first drive pulley 31*c* and first follower pulley 31*d* on which the first tractor belt 31*b* is mounted.

The second tractor 32 includes a second tractor belt 32*b* (second endless belt) with multiple second tractor pins 32*a* disposed on the outside surface, and a second drive pulley 32*c* and second follower pulley 32*d* on which the second tractor belt 32*b* is mounted.

The first drive pulley 31*c* and second drive pulley 32*c* are supported coaxially by the tractor drive shaft 33 and rotate in unison with the tractor drive shaft 33. The first follower pulley 31*d* and second follower pulley 32*d* are supported coaxially and rotate freely on the tractor support shaft 34.

The first tractor pins 31*a* can engage the first sprocket holes 2*a* on one side of the continuous paper 2 width, and the second tractor pins 32*a* can engage the second sprocket holes 2*b* on the other side of the continuous paper 2 width. The first tractor 31 and second tractor 32 also have a tractor cover (not shown in the figure) that partially covers the part holding the continuous paper 2 after the continuous paper 2 is set and held with the sprocket holes 2*a* and 2*b* engaged on the respective tractor pins 31*a*, 32*a*.

The frame 35 includes a main frame portion 35*a* extending in the device width direction Y below the tractor drive shaft 33 and tractor support shaft 34, and a first support panel 35*b* and second support panel 35*c* on opposite sides of the device width direction Y with the conveyance path 21 therebetween.

The first support panel 35*b* supports the first direction Y1 ends of the tractor drive shaft 33 and tractor support shaft 34 (that is, the ends on the first tractor 31 side), and the second support panel 35*c* supports the second direction Y2 ends of the tractor drive shaft 33 and tractor support shaft 34 (that is, the ends on the second tractor 32 side).

The tractor drive shaft 33 can rotate on its axis supported by the first support panel 35*b* and second support panel 35*c*. The tractor support shaft 34 is supported movably in the device width direction Y by the first and second support panels.

A bearing hole 35*d* for supporting the tractor support shaft 34 is disposed in the second support panel 35*c*. The second direction Y2 end of the tractor support shaft 34 passes through the bearing hole 35*d* and is supported by the second support panel 35*c*. A support shaft stop 37 that limits the range of support shaft movement is arranged on the tractor support shaft 34 at a specific distance in the first direction Y1 from the second tractor 32 side end. The support shaft stop 37 is disposed on the inside side (the conveyance path 21 side) of the second support panel 35*c*.

A coil spring 36 that expands and contracts in the device width direction Y is disposed around the outside of the end of the tractor support shaft 34 protruding to the outside (the opposite side as the conveyance path 21) from the second support panel 35*c*. The coil spring 36 is disposed at a position near the outside of the second support panel 35*c* with one end in the spring axis direction connected to the second support panel 35*c*, and the other end connected to the tractor support shaft 34. This other end of the coil spring 36 and the tractor support shaft 34 are connected through an E-ring 38 fixed on the tractor support shaft 34. One of the first and second tractors (e.g., the second tractor 32) is disposed between the coil spring 36 and the other tractor (e.g., the first tractor 31). In the embodiment specifically shown in FIG. 2, the coil spring 36 is separated from the conveyance path 21 by the second support panel 35*c*.

The tractor support shaft 34 can move between a first position 34A and a second position 34B that are displaced from each other in the device width direction Y. The second position 34B indicated by a solid line in FIG. 2 is the position at which the coil spring 36 supports the tractor support shaft 34 in the initial position when continuous paper 2 is not set in the tractor unit 22.

When the tractor support shaft 34 is held in the second position 34B, the coil spring 36 is at its natural length without biasing the tractor support shaft 34, and the support shaft stop 37 is in contact with the second support panel 35*c*. When the tractor support shaft 34 moves in the first direction Y1, the coil spring 36 exerts an urging force urging the tractor support shaft 34 in the second direction Y2, that is, opposite the first direction Y1.

The first position 34A is a position displaced in the first direction Y1 from the second position 34B, and is denoted by the imaginary double-dot dash line in FIG. 2. The first position 34A is where the tractor support shaft 34 is located when the coil spring 36 is fully compressed.

The tractor unit 22 includes a positioning stop 39 that positions the first tractor 31 at a predetermined reference position H in the device width direction Y, and a clamping mechanism 40 that clamps the second tractor 32 to the tractor support shaft 34.

The positioning stop 39 is a flat member that protrudes up from the main frame portion 35*a*, and has a through-hole in which the tractor drive shaft 33 is inserted and rotates, and a through-hole in which the tractor support shaft 34 is inserted and can move in the device width direction. The first tractor 31 is attached to the first direction Y1 side surface of the positioning stop 39, and thereby set to the reference position H. The first tractor 31 is still moveable relative to the tractor support shaft 34 in the device width direction Y.

The clamping mechanism 40, in at least one embodiment, is mounted on the second tractor 32. The clamping mechanism 40 includes, for example, a plastic member that can move between a clamping position pressed against the tractor support shaft 34 and an open position separated from the tractor support shaft 34, and a lever that sets the plastic member to the clamping position or the open position. The clamping mechanism 40 clamps the second tractor 32 to the tractor support shaft 34 when the lever is operated to move the plastic member from the open position to the clamping position. When the second tractor 32 is clamped to the tractor support shaft 34 by the clamping mechanism 40, the second tractor 32 is disposed perpendicularly to the axis of the tractor drive shaft 33 and the axis of the tractor support shaft 34, and the plural second tractor pins 32*a* are aligned with the conveyance direction X. When the second tractor 32 is clamped to the tractor support shaft 34 by the clamping mechanism 40, the second tractor 32 can also move in the device width direction Y in unison with the tractor support shaft 34.

First Conveyance Mechanism

The first conveyance mechanism 23 is disposed between the tractor unit 22 and the printing position A on the conveyance path 21, and more specifically close to the printhead 7. The first conveyance mechanism 23 includes a paper feed roller 41 and a pressure roller 42. The paper feed roller 41 includes a metal roller 43 and a roller shaft 44, and is disposed transverse to the conveyance path 21 at a position below the conveyance path 21 on the z-axis. The pressure roller 42 is rubber or other elastic material, and is configured to press the continuous paper 2 conveyed through the conveyance path 21 against the paper feed roller 41 from above on the z-axis.

As shown in FIG. 2, the surface of the roller 43 has a friction coating 45 formed by a dispersion of inorganic particles. The friction coating 45 is formed by dispersing inorganic particles of aluminum oxide (alumina, $Al_2O_3$), silicon monoxide (SiO), or silicon dioxide ($SiO_2$), for example, in a layer of polyester resin. At least one embodiment uses crushed alumina as the inorganic particles. Alumina is relative inexpensive and does not interfere with reducing cost, is relatively hard, and desirably improves friction resistance. The crushing process also produces alumina particles with sharp corners, resulting in high friction force.

Second Conveyance Mechanism

The second conveyance mechanism 24 is disposed between the printing position A on the conveyance path 21 and the paper exit 6, and more specifically near the printhead 7. The second conveyance mechanism 24 includes a discharge roller 46 and a pressure roller 47. The discharge roller 46 includes a roller 48 and a roller shaft 49, and is disposed transverse to the conveyance path 21 at a position below the conveyance path 21 on the z-axis. The pressure roller 47 is configured to press the continuous paper 2 conveyed through the conveyance path 21 against the discharge roller 46 from above on the z-axis.

Drive power transfer mechanism and drive power transfer wheel train

As shown in FIG. 3, the drive power transfer mechanism 26 has a roller-side drive power transfer mechanism 61 and a tractor-side drive power transfer mechanism 62.

The roller-side drive power transfer mechanism 61 transfers forward rotation for conveying the continuous paper 2 forward (in the direction of arrow X1) through the conveyance path 21, and reverse rotation for conveying the paper in reverse (the direction of arrow X2), from the conveyance motor 25 to the paper feed roller 41 of the first conveyance mechanism 23.

The tractor-side drive power transfer mechanism 62 transfers rotation from the conveyance motor 25 to the tractor drive shaft 33 of the tractor unit 22.

The drive power transfer wheel train 27 causes the discharge roller 46 of the second conveyance mechanism 24 to turn synchronously to the paper feed roller 41 of the first conveyance mechanism 23 at the same conveyance speed in the same direction. The drive power transfer wheel train 27 is denoted by a dotted line in FIG. 3.

The tractor-side drive power transfer mechanism 62 includes a forward transfer mechanism 63 and a reverse transfer mechanism 64. As described below with reference to FIG. 4A and FIG. 4B, the forward transfer mechanism 63 transfers forward rotation from the conveyance motor 25 through a one-way clutch 77 to the tractor unit 22, and the reverse transfer mechanism 64 transfers reverse rotation from the conveyance motor 25 through a torque limiter 79 (torque clutch) to the tractor unit 22.

When conveying the continuous paper 2 forward in at least one embodiment, the conveyance speed of the continuous paper 2 conveyed by the paper feed roller 41 driven through the roller-side drive power transfer mechanism 61 is greater than the conveyance speed of the continuous paper 2 conveyed by the first tractor 31 driven through the forward transfer mechanism 63. The speed reduction ratios of the wheel trains in the transfer mechanisms are set to achieve this relationship.

Conversely, when conveying the paper in reverse, the conveyance speed of the continuous paper 2 conveyed by the first tractor 31 driven through the reverse transfer mechanism 64 is greater than the conveyance speed of the continuous paper 2 conveyed by the paper feed roller 41 through the roller-side drive power transfer mechanism 61. The speed reduction ratios of the wheel trains in the transfer mechanisms are set to achieve this relationship.

The roller-side drive power transfer mechanism 61 includes a drive sprocket 60 fixed coaxially to the output shaft of the conveyance motor 25, a drive gear 66 fixed coaxially to the end part of the roller shaft 44 of the paper feed roller 41 in the first conveyance mechanism 23, and a timing belt 67 mounted on the drive sprocket 60 and drive gear 66.

Figure 4A:
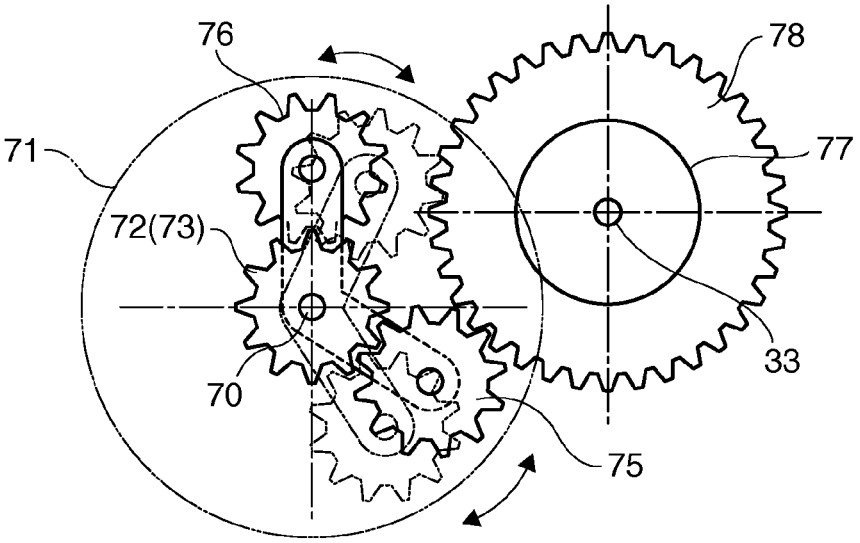
FIG. 4A is a side view showing a tractor-side drive power transfer mechanism in the conveyance device.
Figure 4B:
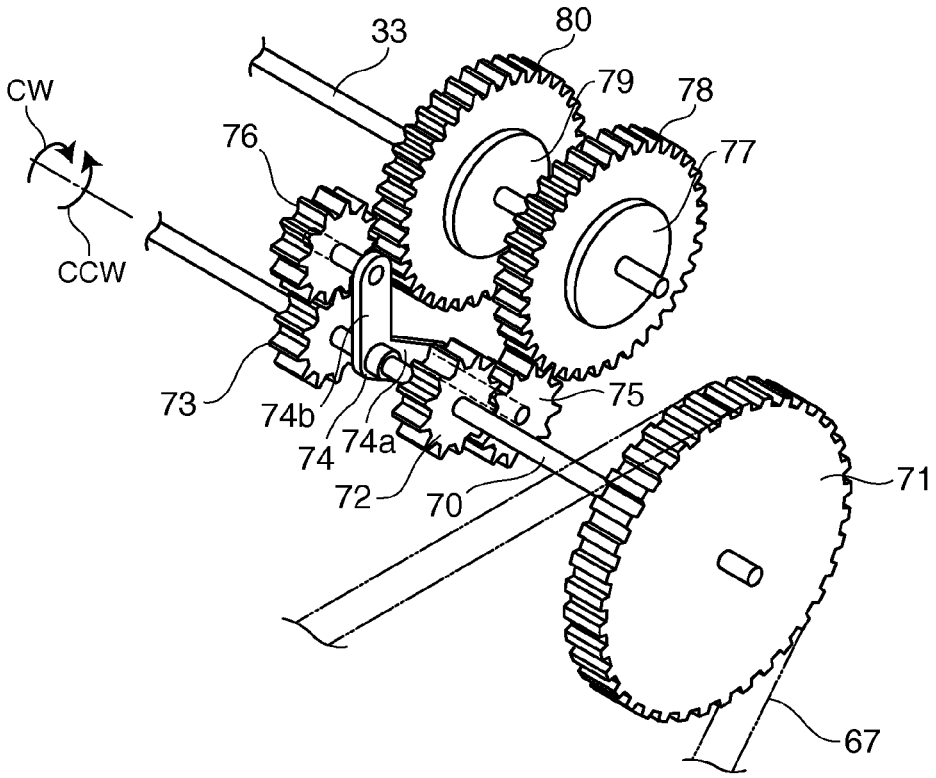
FIG. 4B is a perspective view showing the tractor-side drive power transfer mechanism.

FIG. 4A is a side view showing the tractor-side drive power transfer mechanism 62, and FIG. 4B is a perspective view of the same. The configuration of the tractor-side drive power transfer mechanism 62 that transfers power driving rotation of the tractor unit 22 forward and reverse is described next with reference to FIG. 3, FIG. 4A, and FIG. 4B.

The tractor-side drive power transfer mechanism 62 has a rotating shaft 70, a transfer gear 71 is fixed coaxially to the rotating shaft 70, and the timing belt 67 is mounted on the transfer gear 71. A forward sun gear 72 and a reverse sun gear 73 are fixed coaxially on the rotating shaft 70. A planetary carrier 74 is supported freely pivotably on the rotating shaft 70 between the sun gears 72, 73.

The planetary carrier 74 has two arms 74*a*, 74*b* extending radially with a specific angle therebetween from the rotating shaft 70. A forward planetary gear 75 is supported freely rotationally on the end part of the one arm 74*a*. The forward planetary gear 75 meshes with the forward sun gear 72. A reverse planetary gear 76 is supported freely rotationally on the end part of the other arm 74*b*. The reverse planetary gear 76 meshes with the reverse sun gear 73.

A forward transfer gear 78 is coaxially attached through the one-way clutch 77 to the end part of the tractor drive shaft 33. The one-way clutch 77 could be either a sprag or cam clutch. The one-way clutch 77 transfers forward rotation, but turns freely and interrupts transfer of reverse rotation when reverse rotation for feeding the paper in reverse is received. The one-way clutch 77 therefore turns freely and the power transfer path is also interrupted while transferring forward rotation if a transfer member downstream of the one-way clutch 77 on the transfer path tries to turn faster in the forward rotation direction than the transfer member on the upstream side of the transfer path. When the one-way clutch 77 rotates freely, that is, when the transfer path is interrupted, the first tractor 31 and second tractor 32 follow the movement of the continuous paper 2 conveyed through the conveyance path 21 by the paper feed roller 41.

The forward transfer gear 78 is a gear that can mesh with the forward planetary gear 75, and is disposed at a position opposite the forward planetary gear 75. A reverse transfer gear 80 is disposed beside the forward transfer gear 78. The reverse transfer gear 80 is affixed coaxially to the end of the tractor drive shaft 33 through the torque limiter 79. The reverse transfer gear 80 is a gear that can mesh with the reverse planetary gear 76, and is disposed at a position opposite the reverse planetary gear 76. The torque limiter 79 slips when the transferred torque exceeds a specific limit, and limits transferring torque exceeding the limit.

In the tractor-side drive power transfer mechanism 62 thus comprised, the forward transfer mechanism 63 is the part of the transfer mechanism that sequentially transfers rotation from the timing belt 67 through the rotating shaft 70, forward sun gear 72, planetary carrier 74, forward planetary gear 75, forward transfer gear 78, and one-way clutch 77 to the tractor drive shaft 33. The reverse transfer mechanism 64 is the part that sequentially transfers rotation from the timing belt 67 through the rotating shaft 70, reverse sun gear 73, planetary carrier 74, reverse planetary gear 76, reverse transfer gear 80, and torque limiter 79 to the tractor drive shaft 33.

Figure 5:
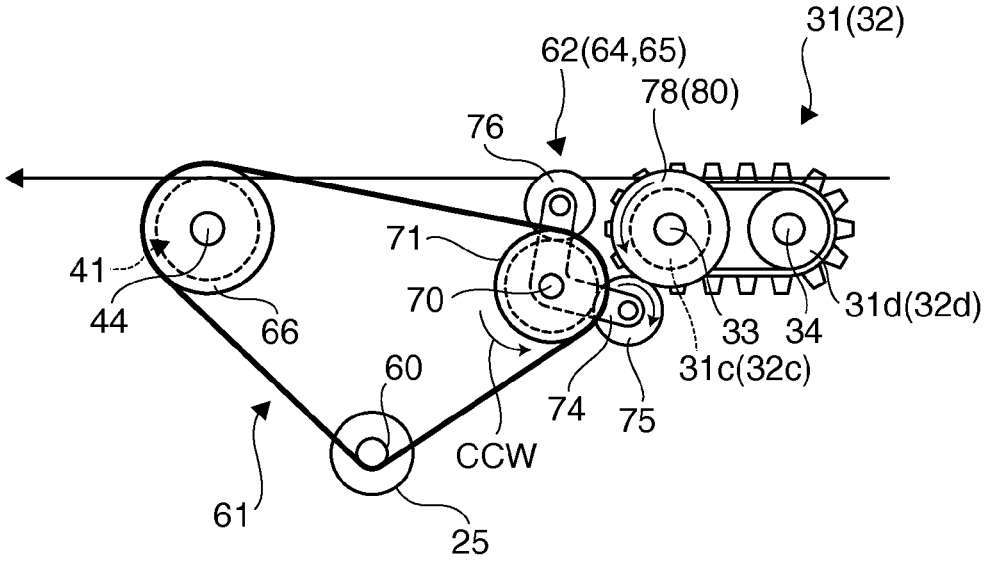
FIG. 5 is a schematic side view showing a roller-side drive power transfer mechanism and a forward rotation transfer mechanism in the conveyance device.
Figure 6:
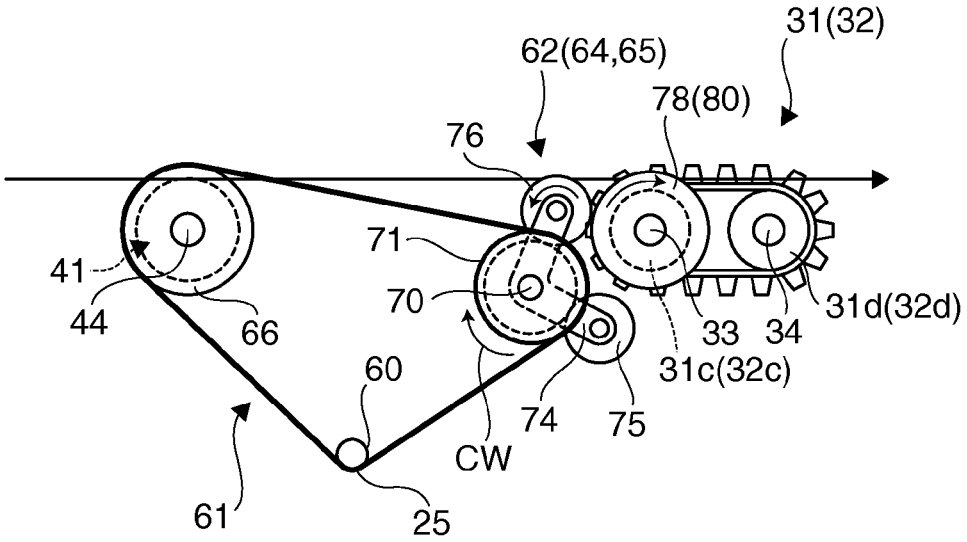
FIG. 6 is a schematic side view showing the roller-side drive power transfer mechanism and a reverse rotation transfer mechanism in the conveyance device.

FIG. 5 is a side view showing the roller-side drive power transfer mechanism 61 and forward transfer mechanism 63. FIG. 6 is a side view showing the roller-side drive power transfer mechanism 61 and reverse transfer mechanism 64.

When transferring forward rotation, the rotating shaft 70 turns counterclockwise as indicated by arrow CCW in FIG. 4B. This rotation causes the planetary carrier 74 to also turn in the same direction. As a result, the forward planetary gear 75 meshes with the forward transfer gear 78. The other reverse planetary gear 76 disengages the reverse transfer gear 80. As a result, the tractor-side drive power transfer mechanism 62 is positioned as shown in FIG. 5.

In this position, forward rotation from the conveyance motor 25 is transferred through the roller-side drive power transfer mechanism 61 to the paper feed roller 41 and discharge roller 46. The forward rotation is also transferred through the tractor-side drive power transfer mechanism 62 to the first tractor 31 and second tractor 32. The continuous paper 2 is therefore fed forward.

When transferring reverse rotation, the rotating shaft 70 turns clockwise as indicated by arrow CW in FIG. 4B. This rotation causes the planetary carrier 74 to also turn in the same direction. As a result, the forward planetary gear 75 separates from and disengages with the forward transfer gear 78 (the drive power transfer path is interrupted). The other reverse planetary gear 76 approaches and engages the reverse transfer gear 80 (completing the drive power transfer path) . As a result, the tractor-side drive power transfer mechanism 62 is positioned as shown in FIG. 6.

In this position, reverse rotation from the conveyance motor 25 is transferred through the roller-side drive power transfer mechanism 61 to the paper feed roller 41 and discharge roller 46. The reverse rotation is also transferred through the tractor-side drive power transfer mechanism 62 to the first tractor 31 and second tractor 32. The continuous paper 2 is therefore fed in reverse (reversed).

Continuous Paper Conveyance Operation

Figure 7A:
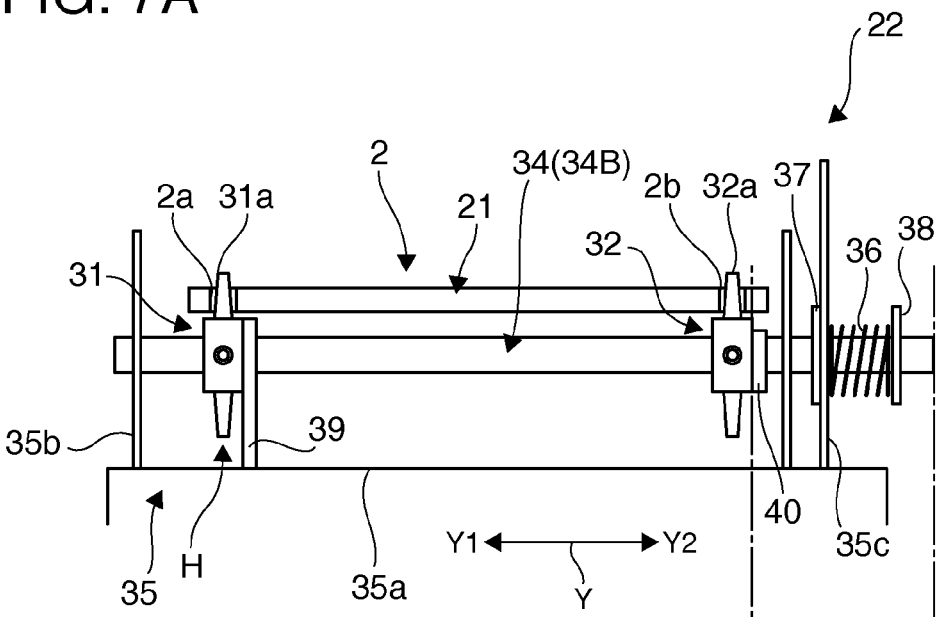
FIG. 7A is a front view that shows a second tractor just before being clamped to a tractor support shaft in the conveyance device.
Figure 7B:
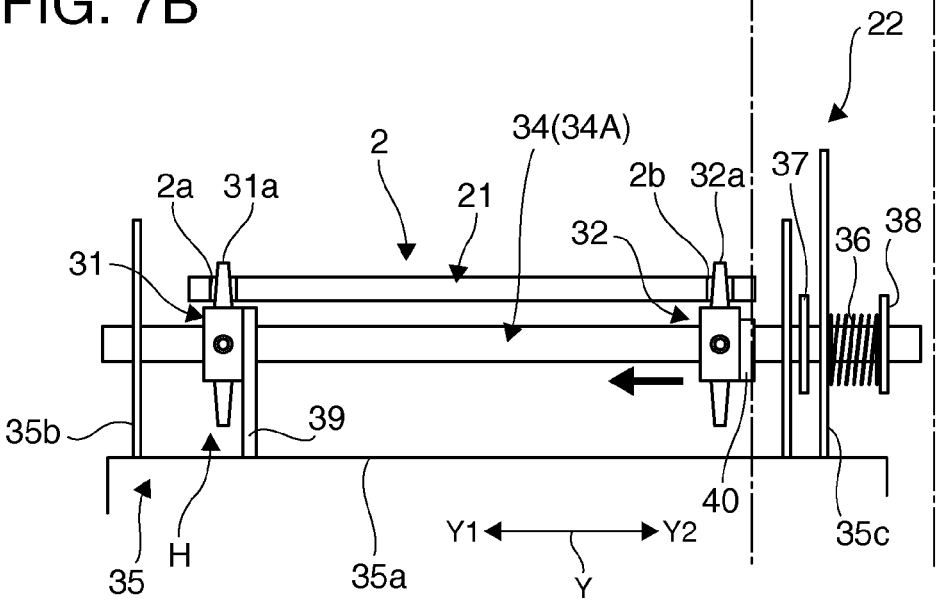
FIG. 7B is a view similar to FIG. 7A showing the second tractor clamped to the tractor support shaft.

Operation of the inkjet printer 1, and particularly the continuous paper 2 conveyance operation of the conveyance device 20, is described next. FIG. 7A and FIG. 7B describe setting the continuous paper 2 in the tractor unit 22, and show the tractor unit 22 from the back in the conveyance direction X. FIG. 7A shows a state immediately before clamping the second tractor 32 to the tractor support shaft 34, and FIG. 7B shows a state after the second tractor 32 is clamped to the tractor support shaft 34.

To set the continuous paper 2 in the tractor unit 22, the first sprocket holes 2*a* on one side of the continuous paper 2 width are placed on the first tractor pins 31*a* of the first tractor 31 disposed at the reference position H in the transverse direction. Next, the second tractor 32 is slid to a position on the tractor support shaft 34 matching the width of the continuous paper 2, and the second tractor pins 32*a* of the second tractor 32 are engaged with the second sprocket holes 2*b* on the other side of the continuous paper 2 width. When the second tractor pins 32*a* of the second tractor 32 have engaged the second sprocket holes 2*b* in the continuous paper 2, the tractor support shaft 34 is held at the second position 34B by the coil spring 36 as shown in FIG. 7A. The second tractor 32 is then clamped to the tractor support shaft 34 by the clamping mechanism 40.

If there is slack in the continuous paper 2 between the first tractor 31 and second tractor 32 when the continuous paper 2 is set in the tractor unit 22, it is possible that the continuous paper 2 becomes skewed when the continuous paper 2 is pulled downstream by the conveyance force of the paper feed roller 41. To avoid or suppress skewing, the user pulls the second tractor 32 away from the first tractor 31 to apply tension to the width of the continuous paper 2 after engaging the second sprocket holes 2*b* of the continuous paper 2 on the tractor pins of the second tractor 32, and then clamps the second tractor 32 to the tractor support shaft 34. However, if the user clamps the second tractor 32 to the tractor support shaft 34 while applying strong tension to the continuous paper 2, the continuous paper 2 may be held with too much tension. When this happens, it is possible that the sprocket holes in the continuous paper 2 disengage the first tractor pins 31*a* or second tractor pins 32*a* if the continuous paper 2 moves in a direction intersecting the conveyance direction X while the continuous paper 2 is conveyed.

To address this potential problem, when excess tension is applied to the continuous paper 2 when the second tractor 32 is clamped to the tractor support shaft 34 in at least one embodiment, the second tractor 32 moves with the tractor support shaft 34 in the first direction Y1 (the direction in which the coil spring 36 stretches) to a position where the urging force of the coil spring 36 and the tension on the continuous paper 2 are balanced (FIG. 7B).

In other words, the spring constant of the coil spring 36 is set appropriately so that the second tractor 32 and tractor support shaft 34 move and the tractor support shaft 34 stops between the first position 34A and second position 34B. Because the excess tension on the continuous paper 2 is relieved by the second tractor 32 moving to a position where the urging force of the coil spring 36 and the continuous paper 2 tension are balanced, the sprocket holes in the continuous paper 2 will not easily separate from the first tractor pins 31*a* or second tractor pins 32*a* even if the continuous paper 2 moves in a direction intersecting the conveyance direction X while the continuous paper 2 is conveyed. Skewing of the continuous paper 2 can also be prevented because the tension across the width of the continuous paper 2 is appropriately maintained by the second tractor 32 being disposed where the urging force of the spring member and the tension on the continuous paper 2 are balanced.

The coil spring 36 in at least one embodiment (biases) exerts urging force on the tractor support shaft 34, and does not (bias) exert urging force that directly urges the first tractor 31 or second tractor 32. Therefore, when the user pulls the second tractor 32 away from the first tractor 31 after engaging the second tractor pins 32*a* with the second sprocket holes 2*b* in the continuous paper 2 when setting the continuous paper 2 in the tractor unit 22, the urging force of the coil spring 36 does not work on the continuous paper 2 or the second tractor 32 that pulls the continuous paper 2. The second tractor 32 can therefore move in the device width direction Y (direction Y2), and the continuous paper 2 can be easily loaded in the tractor unit 22. In addition, when the user pulls the second tractor 32 away from the first tractor 31, the first tractor 31 moves toward the second tractor 32 while compressing the coil spring 36, and the second tractor 32 is not clamped to the tractor support shaft 34 with both the excess tension applied by the pulling force of the user and the urging force of the coil spring 36 applied to the continuous paper 2.

The conveyance motor 25 then drives forward. As a result, the tractor-side drive power transfer mechanism 62 goes to the position shown in FIG. 5, the first tractor 31 and paper feed roller 41 are rotationally driven forward, and the continuous paper 2 is conveyed through the conveyance path 21 toward the paper feed roller 41. The continuous paper 2 conveyed by the first tractor 31 is then nipped between the rotating paper feed roller 41 and pressure roller 42, and conveyed further to a specific indexing position (the start position of the printing operation).

When the continuous paper 2 is conveyed in the X1 direction, the forward conveyance speed of the paper feed roller 41 is greater than the forward conveyance speed of the first tractor 31. The paper holding force of the paper feed roller 41 is increased by the friction coating 45, but is lower than the paper holding force of the tractor 31 whereby the first tractor 31 engages the sprocket holes 2*a*. The continuous paper 2 is therefore conveyed while being pulled with constant tension from the paper feed roller 41 side. As a result, even when fanfold paper supplied from a stack of folded paper is used as the continuous paper 2, the paper can reach the indexing position with folds and slack appropriately removed.

The printhead 7 then prints while the paper feed roller 41 conveys the continuous paper 2 through the conveyance path 21. Because the coefficient of friction of the friction coating 45 is high, the continuous paper 2 is held by the paper feed roller 41 and pressure roller 42 with substantially no slipping, and the continuous paper 2 can be conveyed with high precision. The tractor 31 feeds the continuous paper 2 forward at a slower speed than the paper feed roller 41. The continuous paper 2 can therefore be constantly conveyed with specific tension applied thereto.

When the conveyance direction of the continuous paper 2 by the paper feed roller 41 and the conveyance direction of the continuous paper 2 by the tractor unit 22 do not precisely match due to the dimensional precision of the paper feed roller 41 and parts of the tractor unit 22, or the installation precision of the paper feed roller 41 and tractor unit 22 in the inkjet printer 1, the continuous paper 2 may travel in a direction intersecting the conveyance direction X due to the conveyance force of the paper feed roller 41, and the sprocket holes 2*a*, 2*b* can separate from the first tractor pins 31*a* or second tractor pins 32*a*.

To address this potential problem, the second tractor 32 holding the second direction Y2 edge part of the continuous paper 2 in at least one embodiment follows the movement of the continuous paper 2 and moves with the tractor support shaft 34 in the device width direction Y when the continuous paper 2 moves in the tractor unit 22 in a direction intersecting the conveyance direction X. The sprocket holes 2*a* and 2*b* of the continuous paper 2 can therefore be prevented from separating from the first tractor pins 31*a* or second tractor pins 32*a* while the continuous paper 2 is being conveyed.

When the continuous paper 2 is set in the tractor unit 22 in at least one embodiment, the second tractor 32 moves to a position where the urging force of the coil spring 36 and the tension on the continuous paper 2 are balanced as shown in FIG. 7B. As a result, the second tractor 32 and tractor support shaft 34 can move in both the first direction Y1 and second direction Y2 of the device width direction Y even though the urging force of the coil spring 36 is working on the tractor support shaft 34. The second tractor 32 therefore desirably follows movement of the continuous paper 2 in the device width direction Y. The sprocket holes 2*a* and 2*b* of the continuous paper 2 therefore do not easily separate from the first tractor pins 31*a* or second tractor pins 32*a*.

Furthermore, because the conveyance speed of the paper feed roller 41 is faster than the conveyance speed of the tractor unit 22, excess tension is applied by the conveyance force of the paper feed roller 41 while conveying the continuous paper 2, and it is possible that the sprocket holes 2*a* and 2*b* of the continuous paper 2 are separated from the first tractor pins 31*a* or second tractor pins 32*a* when the continuous paper 2 moves on the tractor unit 22 in the device width direction Y intersecting the conveyance direction X of the continuous paper 2.

By using a one-way clutch 77 in the tractor-side drive power transfer mechanism 62, at least one embodiment of the invention addresses this potential problem and prevents the conveyance force of the paper feed roller 41 from applying excess tension while conveying the continuous paper 2. More specifically, when the tension on the continuous paper 2 due to the conveyance force of the paper feed roller 41 exceeds a specific limit, the first tractor pins 31*a* of the first tractor 31 and the second tractor pins 32*a* of the second tractor 32 are forcibly pulled in the forward rotation direction by the paper feed roller 41, thus causing the one-way clutch 77 to turn freely and allow movement of the first tractor pins 31*a* and second tractor pins 32*a*. In other words, because the first tractor 31 and the second tractor 32 can simply follow movement of the continuous paper 2, the tension on the continuous paper 2 does not increase. The sprocket holes 2*a* and 2*b* of the continuous paper 2 can be prevented from easily separating from the first tractor pins 31*a* or second tractor pins 32*a* during paper conveyance. High print quality can also be achieved because the one-way clutch enables conveying the continuous paper 2 forward in a consistent, desirably tensioned state.

The continuous paper 2 conveyed by the paper feed roller 41 passes the printing position A of the print unit 5 and is printed on by the printhead 7. The continuous paper 2 then passes between the rotating discharge roller 46 and pressure roller 47. The continuous paper 2 is then further conveyed through the conveyance path 21 by the discharge roller 46, and discharged from the paper exit 6 into the discharge tray 16.

When the continuous paper 2 is to be conveyed in the reverse direction, the conveyance motor 25 is driven in the reverse rotation direction. This reverse rotation is transferred through the roller-side drive power transfer mechanism 61 to the paper feed roller 41, and through the tractor-side drive power transfer mechanism 62 to the first tractor 31. This causes the tractor-side drive power transfer mechanism 62 to disengage the forward transfer mechanism 63 and engage the reverse transfer mechanism 64 as shown in FIG. 6.

As described above, the conveyance speed of the continuous paper 2 by first tractor 31 is greater than the conveyance speed of the continuous paper 2 by the paper feed roller 41 when the continuous paper 2 is conveyed in reverse. The continuous paper 2 is therefore reversed with specific tension, and paper jams due to slack or creases in the paper, for example, are prevented. The reverse rotation is also transferred through the torque limiter 79 to the tractor drive shaft 33. The torque limiter 79 releases and turns freely (slips) when the transferred torque exceeds a specific limit, and torque transfer is limited to less than the torque limit. The torque limiter 79 also slips when excess torque is applied to the continuous paper 2, and tension on the continuous paper 2 is therefore limited to less than the specific limit. Problems such as excessive torque causing the sprocket holes 2*a* and 2*b* of the continuous paper 2 to disengage the first tractor pins 31*a* or second tractor pins 32*a* can therefore be prevented.

Tractor Unit Variation

In one or more embodiments described above, the first tractor 31 is attached to the positioning stop 39 disposed on the frame 35 and thereby fixed in the reference position H, but the first tractor 31 can be disposed at the reference position H while being moveable relative to the frame 35 within a limited range in the device width direction Y. If the positioning member in this configuration has a first stop disposed on one side of the first tractor 31 in the device width direction Y with a small gap to the first tractor 31, and a second stop on the opposite side of the first tractor 31 with a small gap to the first tractor 31, the first tractor 31 can be disposed at the reference position H while being moveable in the device width direction Y between the first stop and the second stop. If the first tractor 31 is disposed at the reference position H while being moveable in a specific range in the device width direction Y, the sprocket holes 2*a* and 2*b* of the continuous paper 2 can also be prevented from disengaging the first tractor pins 31*a* or second tractor pins 32*a* by movement (chatter) of the first tractor 31 in the device width direction Y.

One or more embodiments of the invention can also be applied to a conveyance device 20 that conveys the continuous paper 2 by driving the paper feed roller 41, so that the second tractor 32 can track and follow movement of the continuous paper 2 conveyed by the paper feed roller 41. One or more embodiments of the invention can also prevent or suppress disengagement of the sprocket holes 2*a* and 2*b* of the continuous paper 2 from the first tractor pins 31*a* or second tractor pins 32*a* in the tractor unit 22. Desirable tension on the continuous paper 2 can also be maintained during media conveyance.

It will be apparent that variations to the above specifically described embodiments may be made. Such variations are not to be regarded as a departure from the spirit and scope of the disclosure.

What is claimed is:

1. A tractor unit, comprising:

a first tractor having first tractor pins configured to be engaged in first sprocket holes formed in continuous paper to be conveyed in a conveyance direction along a first side of the continuous paper;

a second tractor having second tractor pins configured to be engaged in second sprocket holes formed in the continuous paper along a second side of the continuous paper, the second side opposite the first side across a paper width of the continuous paper;

a support shaft that extends in a transverse direction perpendicular to the conveyance direction of the continuous paper, and supports the first tractor and second tractor movably in the transverse direction;

a frame that supports the support shaft movably in the transverse direction;

a biasing member configured to bias the support shaft in the transverse direction; and a clamping member configured to fix the second tractor on the support shaft;

the first tractor being disposed at a predetermined reference position in the transverse direction, and in response to a movement of the support shaft in a first direction oriented from the second tractor toward the first tractor, the biasing member configured to bias the support shaft in a second direction opposite the first direction.

2. The tractor unit of claim 1, wherein:

the support shaft is moveable between a first position and a second position displaced from the first position in the second direction; and the biasing member does not bias the support shaft when the support shaft is in the second position.

3. The tractor unit of claim 2, wherein:

the biasing member is a spring, and the spring member is at a natural length thereof when the support shaft is in the second position.

4. The tractor unit of claim 1, wherein:

the frame has a support part that supports the support shaft with an end of the support shaft passing through the support part; and the biasing member is a coil spring disposed with an axis of the spring oriented in the transverse direction, one axial end of the biasing member connected to the support part, and the other axial end of the biasing member connected to the support shaft.

5. The tractor unit of claim 1, wherein one of the first and second tractors is disposed between the biasing member and the other tractor.

* * * * *